US007596432B2

(12) United States Patent
Boer et al.

(10) Patent No.: US 7,596,432 B2
(45) Date of Patent: Sep. 29, 2009

(54) METHOD FOR ESTIMATING THE FOOD TEMPERATURE INSIDE A REFRIGERATOR CAVITY AND REFRIGERATOR USING SUCH METHOD

(75) Inventors: Alessandro Boer, Cassinetta Di Biandronno (IT); Raffaele Paganini, Varese (IT); Rocco Petrigliano, Valsinni (IT); Paolo Sicher, Varese (IT); Paolo Toniolo, Mercallo (IT); Alessandra Suardi, Falconara Marittima (IT)

(73) Assignee: Whirlpool Corporation, Benton Harbor, MI (US)

( * ) Notice: Subject to any disclaimer, the term of this patent is extended or adjusted under 35 U.S.C. 154(b) by 270 days.

(21) Appl. No.: 11/470,650

(22) Filed: Sep. 7, 2006

(65) Prior Publication Data

US 2008/0221740 A1 Sep. 11, 2008

(30) Foreign Application Priority Data

Sep. 7, 2005 (EP) ..... 05108205

(51) Int. Cl.
*G05D 23/00* (2006.01)

(52) U.S. Cl. ..... 700/300

(58) Field of Classification Search ..... 700/12, 700/50, 300

See application file for complete search history.

(56) References Cited

U.S. PATENT DOCUMENTS

| | | | | |
|---|---|---|---|---|
| 4,633,672 | A * | 1/1987 | Persem et al. | 62/126 |
| 4,843,833 | A * | 7/1989 | Polkinghorne | 62/180 |
| 5,884,491 | A | 3/1999 | Kim et al. | 69/89 |
| 6,034,607 | A | 3/2000 | Vidaillac | 340/585 |
| 6,408,635 | B1 * | 6/2002 | Pham et al. | 62/222 |
| 6,449,972 | B2 * | 9/2002 | Pham et al. | 62/228.3 |
| 6,662,578 | B2 * | 12/2003 | Pham et al. | 62/154 |
| 6,976,368 | B1 * | 12/2005 | Lamstaes et al. | 62/130 |
| 2004/0261431 | A1 * | 12/2004 | Singh et al. | 62/125 |

FOREIGN PATENT DOCUMENTS

| | | |
|---|---|---|
| EP | 0686818 | 12/1995 |
| JP | 05203313 | 8/1993 |

OTHER PUBLICATIONS

European Search Report EP 05108205.5-2301 Dated Jan. 31, 2006.

* cited by examiner

*Primary Examiner*—Albert DeCady
*Assistant Examiner*—Chad Rapp
(74) *Attorney, Agent, or Firm*—Kirk W. Goodwin; Diederiks & Whitelaw PLC

(57) ABSTRACT

A method of controlling the temperature inside a cavity of a cooling appliance provided with a temperature sensor inside the cavity and with an actuator for adjusting the cooling capacity of the appliance, the food temperature is estimated on the basis of a value from the temperature sensor and on a predetermined function of a status of the actuator.

9 Claims, 11 Drawing Sheets

METHOD FOR ESTIMATING THE FOOD TEMPERATURE INSIDE A REFRIGERATOR CAVITY AND REFRIGERATOR USING SUCH METHOD

BACKGROUND OF THE INVENTION

1. Field of the Invention

The present invention relates to a method for controlling the temperature inside a cavity of a cooling appliance provided with a temperature sensor inside the cavity and with an actuator to adjust the cooling capacity of the appliance. With the term "actuator" we intend all the actuators of the cooling appliance (compressors, dampers, valves, fans, etc.) which are used by the control system of the appliance for maintaining certain conditions in the cavity as set by the user, i.e. to adjust the cooling capacity of the appliance.

2. Description of the Related Art

Traditionally the temperature inside a refrigerator cavity is controlled by comparing the user set temperature with a measured temperature coming from a dedicated sensor. The user set temperature is converted into a Cut-off and Cut-On temperature and the measured temperature is compared to these two values in order to decide the compressor state (on/off or speed thereof in case of variable speed compressor) according to a so-called hysteresis technique. A similar approach is also used to generate over temperature alarm messages: the measured probe temperature (and some related quantities such as its derivative vs. time) is compared with a set of predetermined values and, based on the comparison, a warning or alarm message is generated. The drawbacks of this kind of known solutions are related to the fact that the look-up tables and predetermined values are the result of a compromise among all the possible work conditions. The result is a poorly controlled food temperature in response to different external temperatures, different load conditions and possible non-coherent alarm indications (false alarms or non-signaled alarms).

SUMMARY OF THE INVENTION

An object of the present invention is to provide an estimation of the average food temperature inside a freezer or refrigerator cavity with the use of a single temperature sensor inside this cavity. This estimation has two different main purposes. The first one is to contribute at the food preservation performances of the refrigerator by providing the appliance control algorithm with a temperature that is closer to the actual food temperature than the rough ambient temperature coming from the sensor inside the cavity. The second one is to minimize the risk of a false over temperature warning messages or undetected over-temperature conditions.

In a preferred embodiment, the present invention teaches the use of an estimation algorithm able to estimate the average food temperature inside a refrigerator cavity or in a special part of the cavity (drawer, shelf . . . ). This is done with the use of a single temperature sensor inside the cavity. According to the invention, the temperature coming from this sensor is correlated with the actuators state trends, these actuators being for example: the compressor, the damper which modulates the air flow between the freezer and the refrigerator compartments (in case of no-frost refrigerators), the fan, the heater for defrosting the evaporator or combination thereof. This correlation allows the conversion of the measured probe temperature into the most probable value of the food temperature.

BRIEF DESCRIPTION OF THE DRAWINGS

In the following description we make reference to the appended drawings in which.

DETAILED DESCRIPTION OF THE PREFERRED EMBODIMENTS

According to one aspect of the present invention, the correlation or conversion from the measured temperature (inside the cavity) and the estimated food temperature are done according to a "thermal flux" principle. The temperature difference or gradient ΔT between two points inside a cavity depends on the heat transfer coefficient G between these two points and the heat flow rate Q (thermal flux) passing from one point to the other. An approximated description of this phenomenon can be given by the following formula:

$$\Delta T = \frac{1}{G} \cdot Q \qquad \text{(eq. 1)}$$

The estimation algorithm according to the present invention is based on this formula. We define the temperature difference ΔT as the difference of temperatures between two particular points inside the cavity: PS and PF.

PS is the point inside the cavity where the temperature sensor S is placed. PF can be chosen as the point inside the refrigerator having the temperature equal to the overall average food temperature or the temperature of the food that has to be monitored or controlled. If we indicate the temperature in correspondence of the point PS as MT (Measured Temperature) and the temperature at the point PF as FT (Food Temperature), we obtain:

$$MT - FT = \frac{1}{G} \cdot Q \quad \text{(eq. 2)}$$

Figure 1:
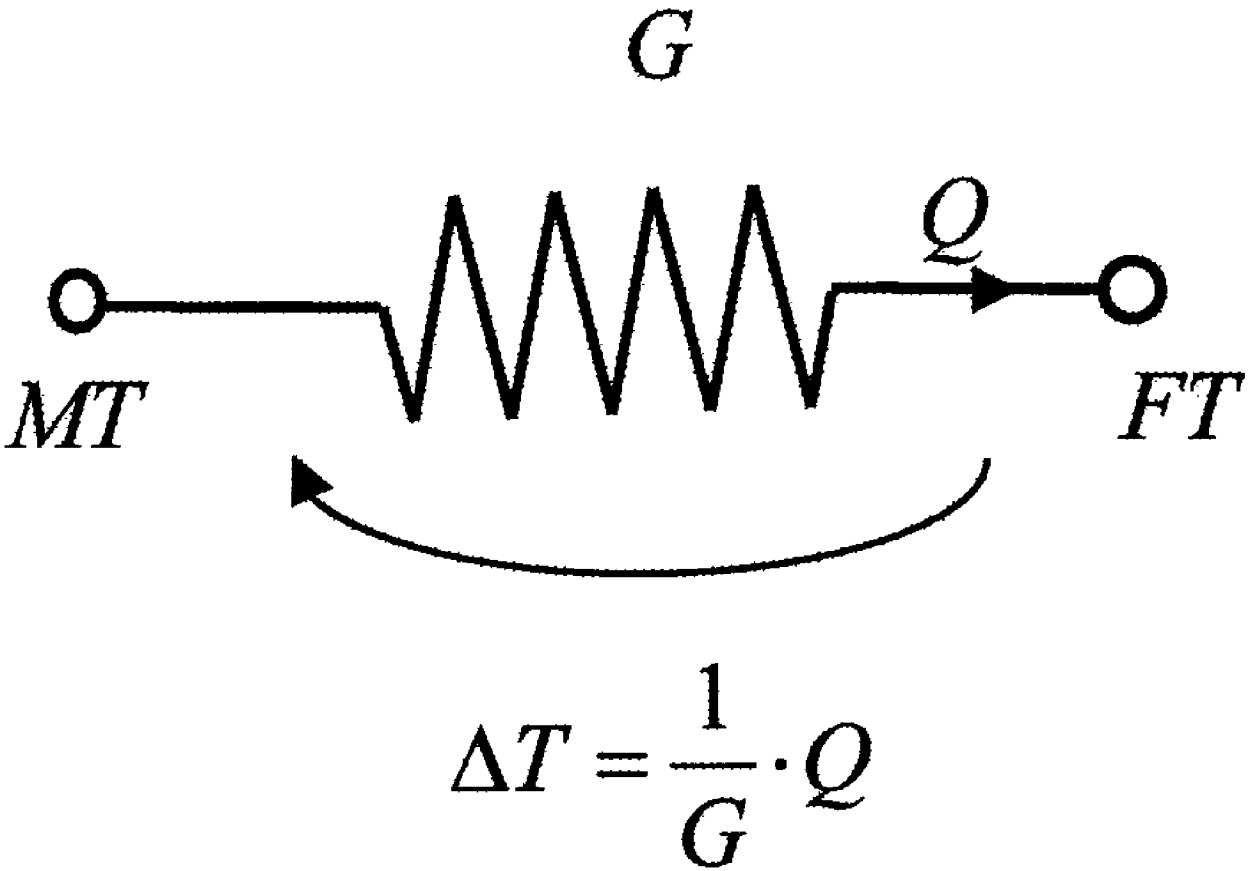
FIG. 1 shows an electrical representation of thermal flux principle that is the basis of the algorithm according to the present invention.

FIG. 1 shows an electrical representation of this phenomenon. According to the eq.2, an estimation of the food temperature can be obtained using the following formula:

$$FT = MT - \frac{1}{G} \cdot Q \quad \text{(eq. 3)}$$

The sensor S directly measures MT, 1/G is a parameter depending on the appliance and on the considered load condition (food type and position). Each load condition and each sample of appliance provides a specific value for G. An average value for this parameter must be found during the design phase.

The flow rate is strictly dependent on the temperature of the cold source of the cavity (i.e. the evaporator). If such temperature cannot be measured (a typical situation where this invention can be used), the value of Q can be estimated by processing the actuators (fans, compressor, damper) trends. The quantity $$\frac{1}{G} \cdot Q$$

is defined as Offset Temperature OT:

$$OT = \frac{1}{G} \cdot Q \quad \text{(eq. 4)}$$

According to this estimation, the food temperature can be described as:

$$FT = MT - OT \quad \text{(eq. 5)}$$

One aspect of this invention is to provide a method for determining the quantity OT so that, according to the eq.5, an estimation of the food temperature FT can be obtained.

Figure 2:
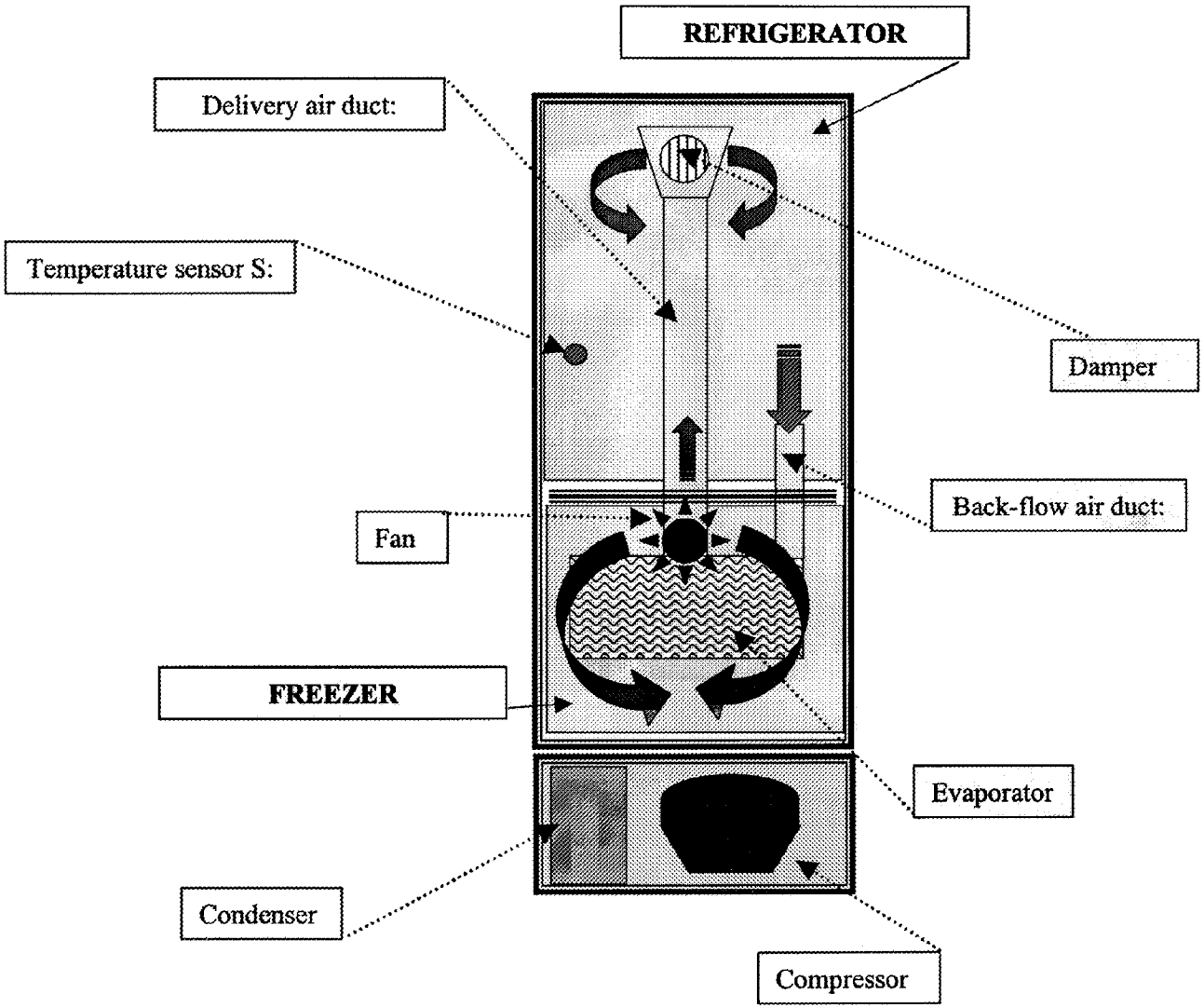
FIG. 2 shows a schematic representation of a cooling appliance where the present invention is implemented.

In order to describe the method used for the estimation of the food temperature, an experimental prototype of a no frost bottom mount refrigerator/freezer will be used. A schematic representation of this refrigerator/freezer is shown in FIG. 2. The main actuators in this case are the compressor, the fan and the damper. The compressor cools the evaporator inside the freezer cell (at the bottom). The fan blows the cold air into the freezer cavity and (if the damper is open) to the upper refrigerator cavity. The description of the method according to the invention will be focused on the refrigerator cavity only.

According to the eq. 1, the offset temperature OT is proportional to the thermal flux Q. Thermal flux is mainly related to the evaporator temperature (i.e. the cold source): the colder the evaporator temperature, the higher the OT tends to be. Patent application EP1 450 230 describes in detail a possible method to estimate the offset temperature when a dedicated temperature sensor on the evaporator sensor is placed on the evaporator in addition to the temperature sensor S. Another aspect of the present invention is to estimate the offset temperature without a dedicated additional sensor. The evaporator temperature is indirectly affected by the action of the actuators. The higher the actuators workload, the colder the evaporator temperature. This can be summarized assuming that the offset temperature can be considered as a function of the actuators trends:

$$OT = f(\text{Actuators}(t)).$$

In the specific case this function can be rewritten as:

$$OT(t) = f(\text{Compressor}(t,t0), \text{Damper}(t,t0))$$

The terms Compressor(t,t0) and Damper(t,t0) represent the average trend of the status of the compressor and the damper vs. time. One of the most common ways to compute this value is the use of IIR (infinite impulse response) filters. According to this solution, these two quantities will be obtained with the following formulas:

$$\text{Compressor}(t,t0) = (1-\alpha) \cdot \text{Compressor}(t-Dt,t0) + \alpha \cdot C(t) \quad \text{(eq. 6)}$$

$$\text{Damper}(t,t0) = (1-\beta) \cdot \text{Damper}(t-Dt,t0) + \beta \cdot D(t) \quad \text{(eq. 7)}$$

C(t) and D(t) represent the status of the compressor and of the damper at the instant t. D=0 represents damper closed, D=1 represents damper open. C=0 represents compressor "off", C=1 represents compressor "on". It's important to remark that the specific case used to describe the invention takes in consideration an ON/OFF compressor and an ON/OFF damper. The concepts and the technical solutions according to the invention can be extended to the case of "continues" actuators without limitations. The parameters α and β (inside the range 0-1) determine the "speed" of the filters in reaching the average value. The closer the value to 1, the faster the filter, which is good, but this allows the filter to be too sensitive to the disturbances (door opening, food introductions, defrost, etc.). Moreover the value of these parameters should be small enough to filter the effects of the actuators cycling set by the temperature control.

As an example, we can consider the function f as linear. In this case we have:

$$OT(t) = \alpha \cdot \text{Compressor}(t,t0) + b \cdot \text{Damper}(t,t0) + c \quad \text{(eq. 8)}$$

In the design phase, the value of a, b, c can be obtained through a well-defined set of experimental tests on the specific cooling appliance. These tests must be executed by measuring the quantities OT(t), Compressor(t,t0) and Damper(t, t0) in the most significant work conditions, considering different external temperatures, different load quantities inside the refrigerator and different load positions. The parameters a, b, c can be obtained from the experimental data with the common identification techniques, for example, the least square method is suitable for this purpose.

Figure 3:
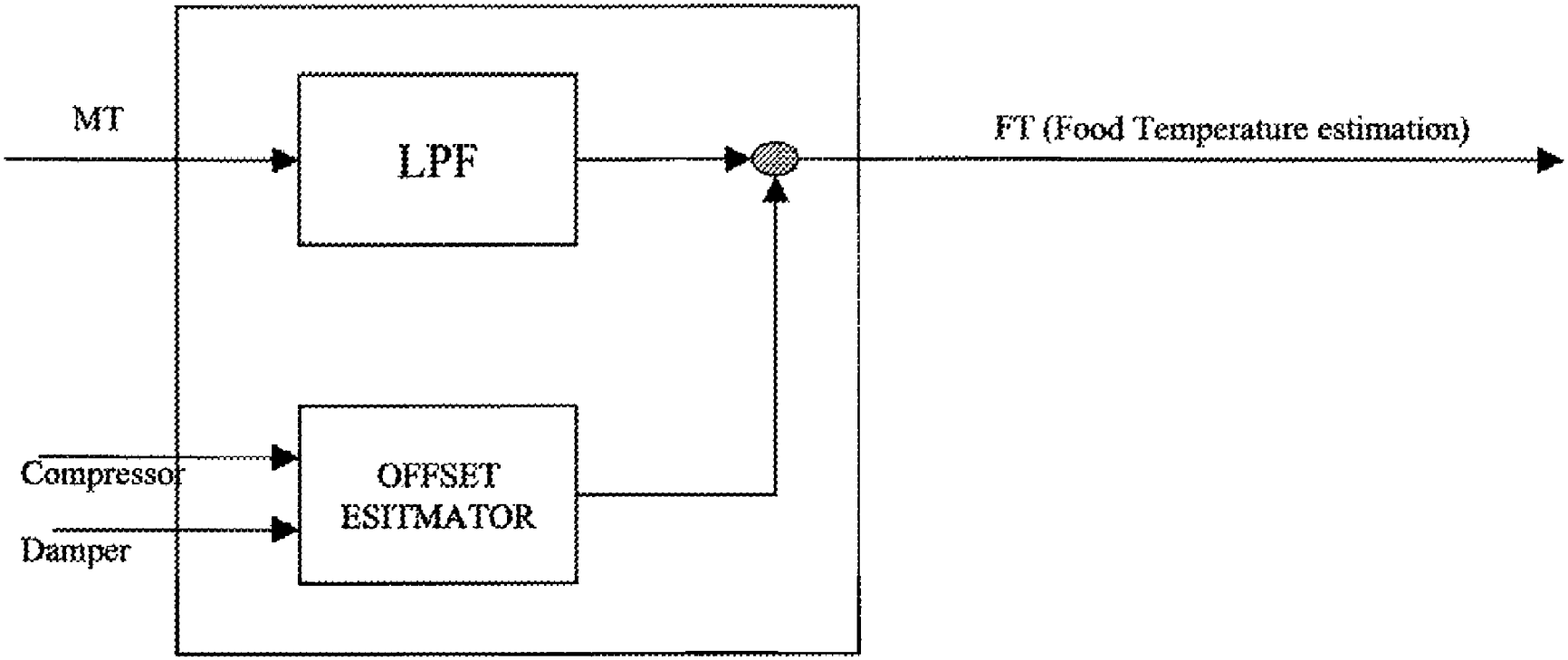
FIG. 3 shows a estimation block diagram of the food temperature estimation used in the present invention.

The food temperature estimation can be obtained from the offset temperature according to the eq.5. Most of the time the measured temperature must be pre-filtered with a low pass filter to be used for this purpose. This has to be done because the measured temperature is a measure of the air temperature close to the sensor S. This gets the dynamics of MT too "fast" to be taken as it is in the equation 5. For this reason a low pass filter LPF can be used before adding the measured temperature to the offset temperature in the eq.5. FIG. 3 summarizes a block diagram representation of the described estimation algorithm.

As mentioned at the beginning of the description, the estimation of OT can be used with mainly two purposes:

1. To provide a more precise food temperature control.

2. To provide a more reliable over temperature alarm message.

Figure 4:
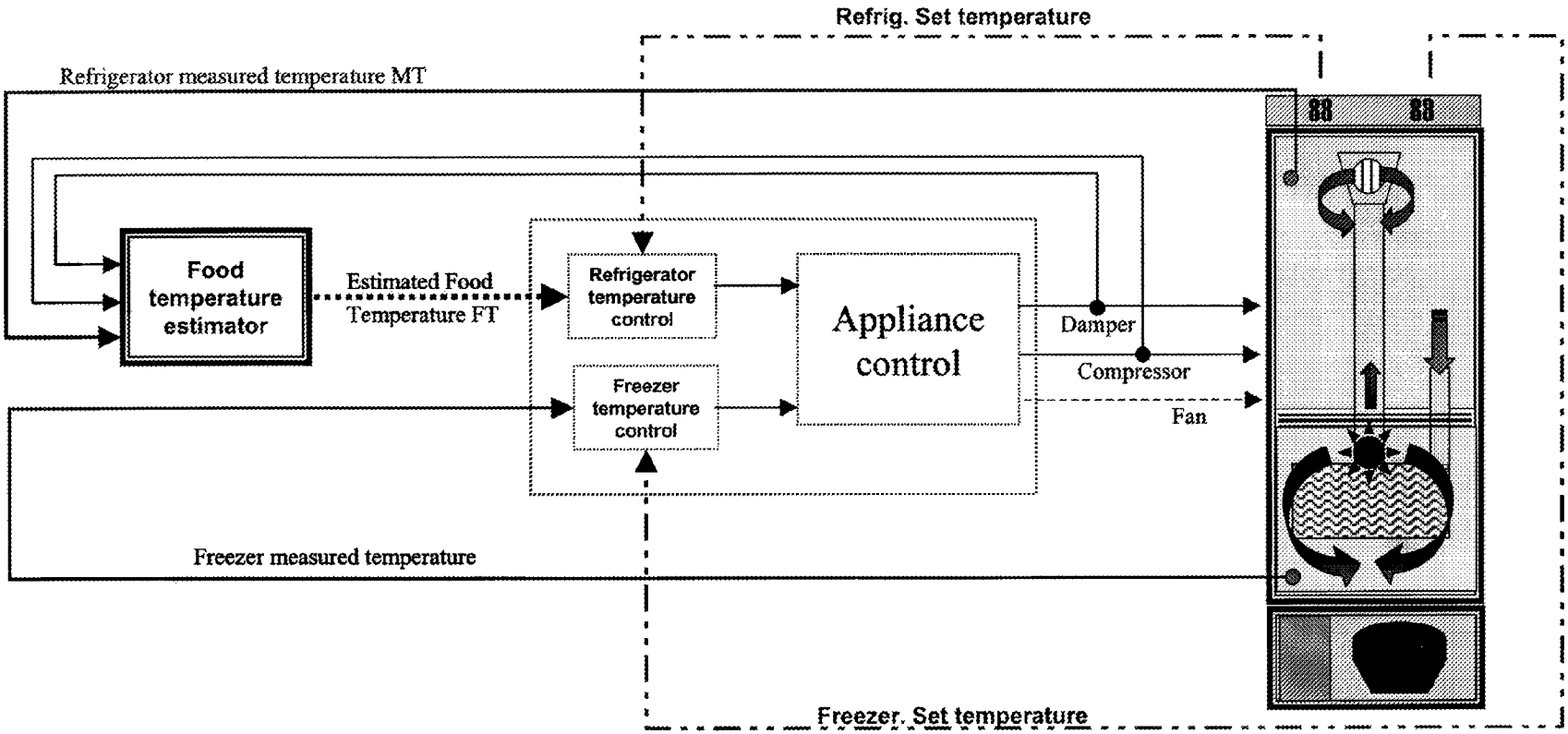
FIG. 4 shows a block diagram where the estimated food temperature is used to provide a more precise food temperature control in the refrigerator compartment.
Figure 5:
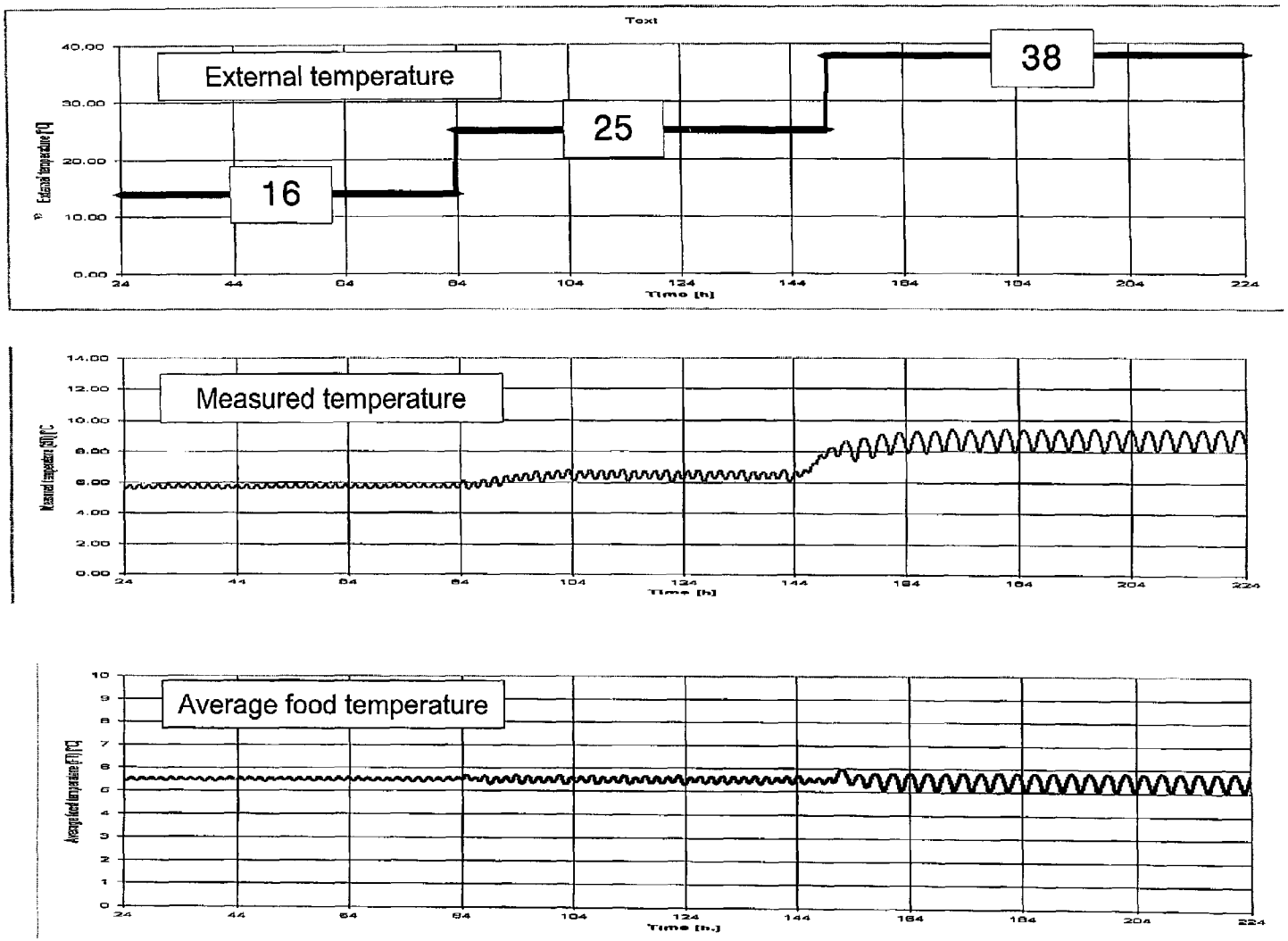
FIG. 5 shows the effect of the food estimator temperature according to FIG. 4 in the presence of different external temperatures: the measured temperature varies in order to maintain a constant food temperature.
Figure 6:
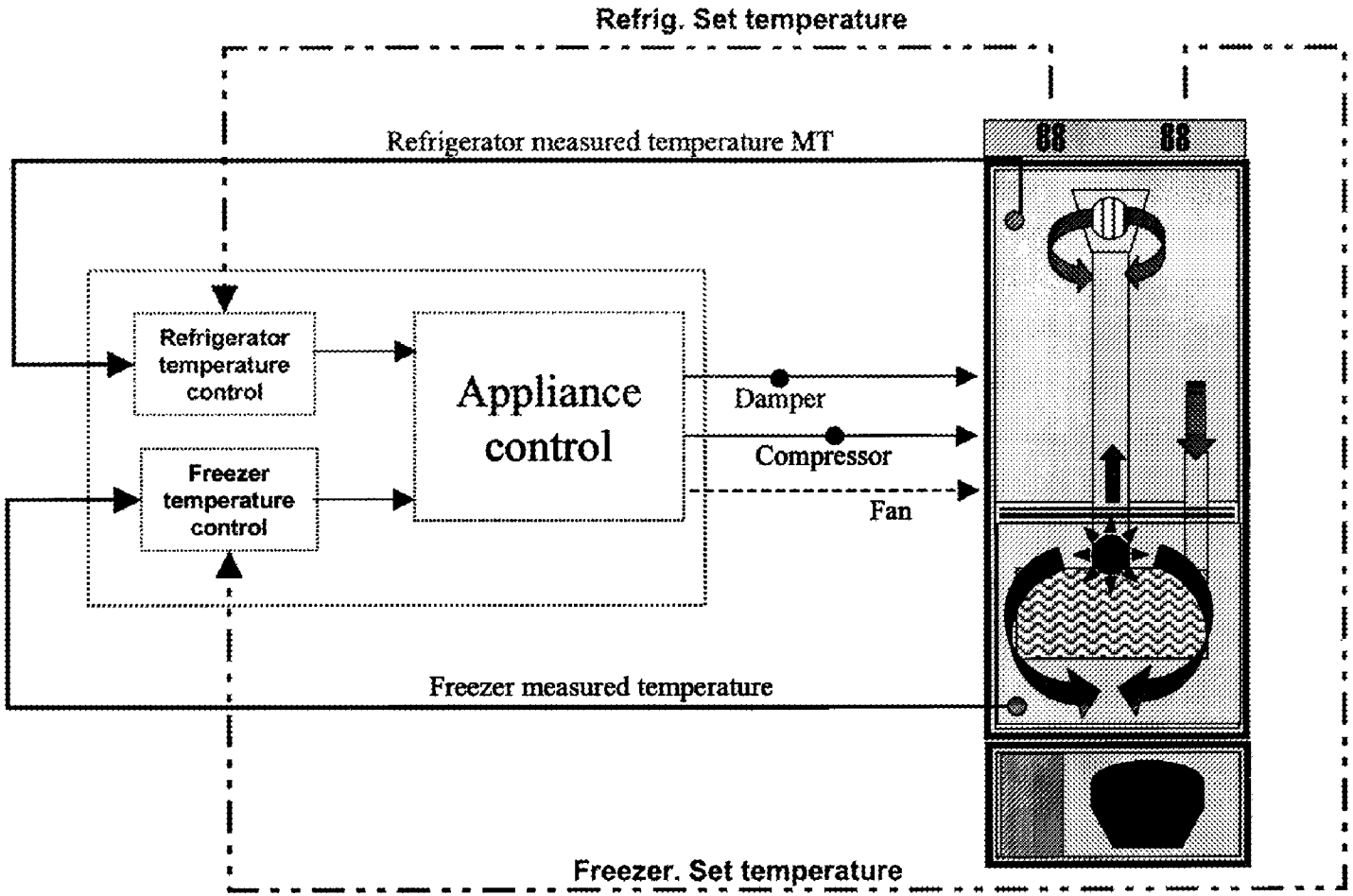
FIG. 6 shows the block diagram representation of a traditional control system in which the measured temperature is the actual controlled temperature.
Figure 7:
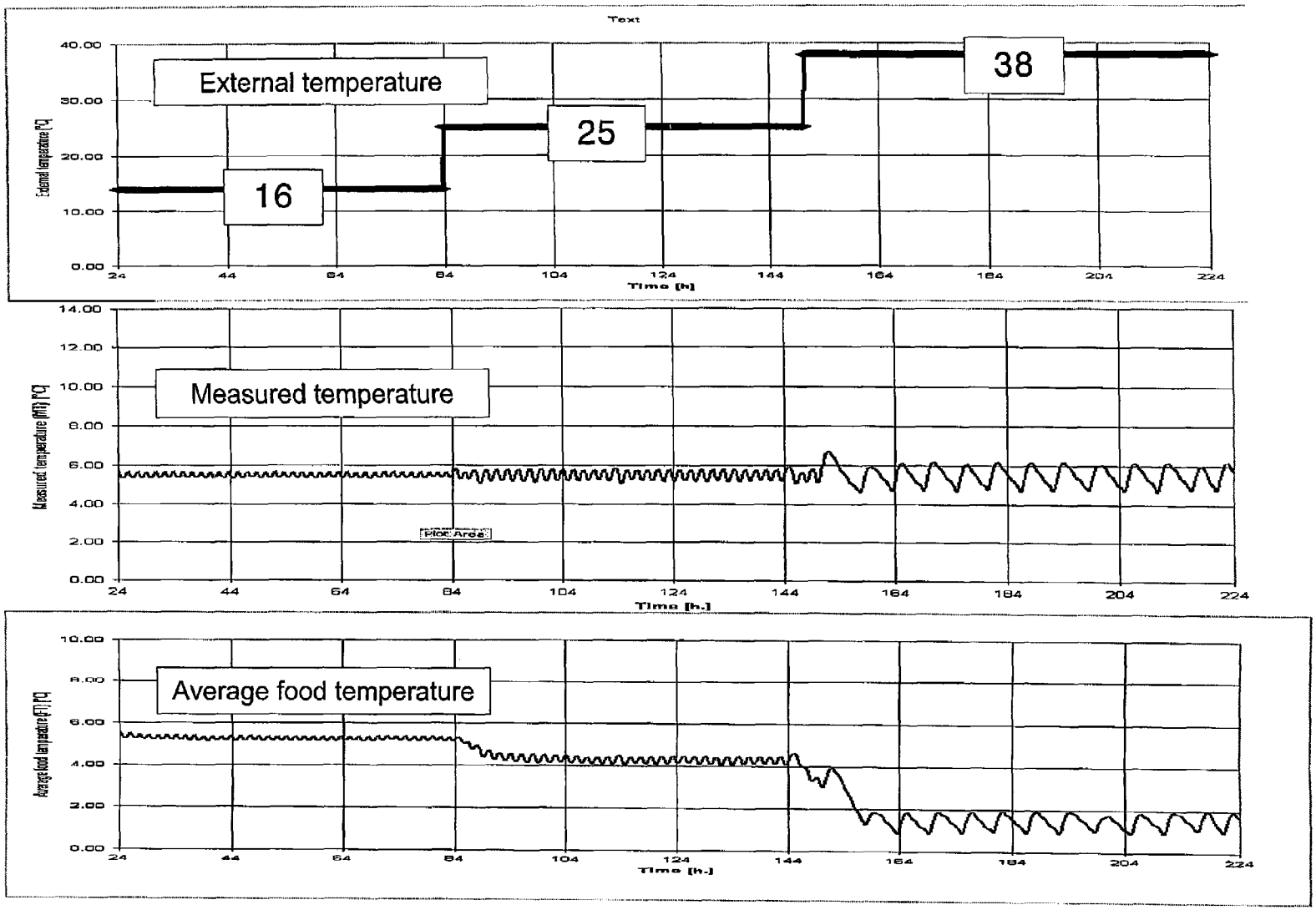
FIG. 7 shows the temperature trends when the traditional solution according to FIG. 6 is used and in which the average measured temperature is kept constant but the food temperature drifts with the external temperature changes.

FIG. 4 shows a block diagram where, according to the present invention, the estimation of the food temperature is used to provide a precise food temperature control in the refrigerator compartment. It can be noticed how the refrigerator temperature control is fed by the estimated food temperature and not directly by the measured temperature. The advantages of this solution are evident in the presence of external temperature changes. This is shown in FIG. 5 that reports the test results of the considered prototype controlled according to the block diagram of FIG. 4. Thanks to the use of the algorithm according to the invention, the average food temperature doesn't change with the external temperature variation. On the contrary, the measured temperature changes its average value with the external temperature. This aspect is further clearer looking at FIG. 7 where the same work conditions are set without using the food estimator block (diagram of FIG. 6). As traditionally done, the measured temperature is "well-controlled" in all the conditions (its average value is constant) but the food temperature drifts with the external temperature changes (It can be noticed how in the considered case an increase of the external temperature gives a decrease of the average food temperature with the probe temperature constant. This behavior is specific of the considered example. An increase of external temperature could give an increase or a decrease of the average food temperature, depending mainly on the probe temperature position).

Figure 8:
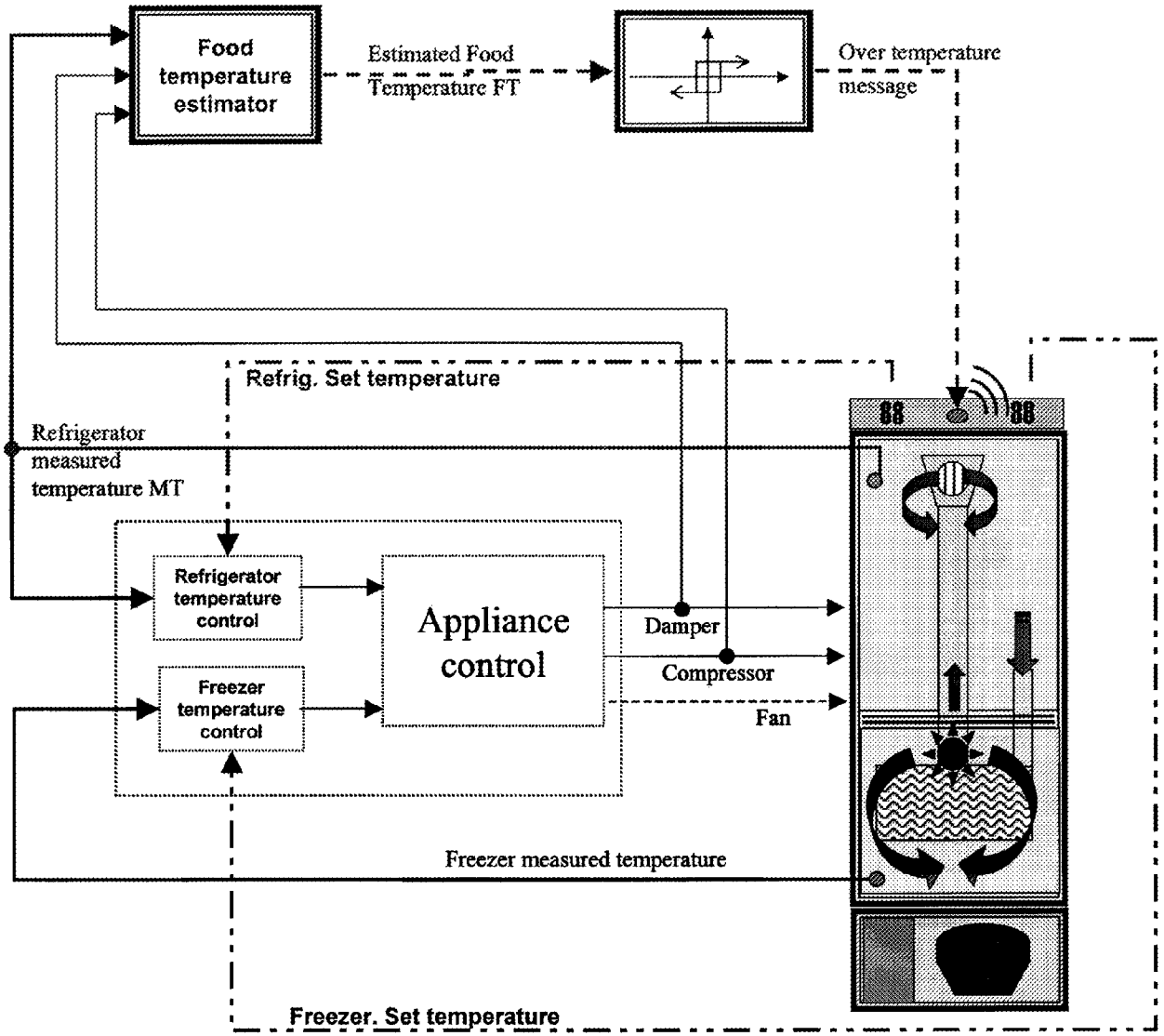
FIG. 8 shows a block diagram where the food estimator according to the invention is used to generate a coherent warm food temperature alarm.
Figure 9:
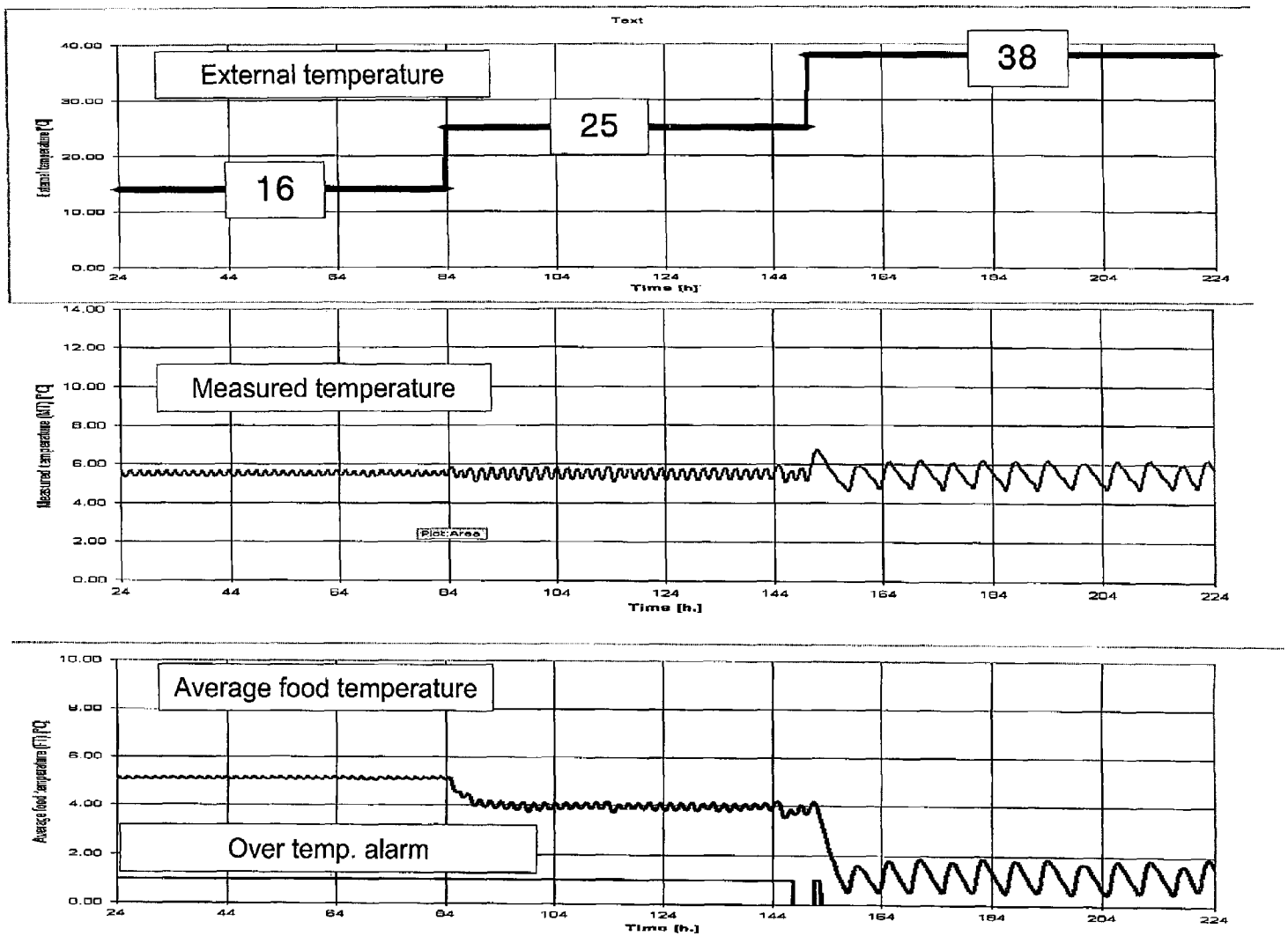
FIG. 9 shows the temperature trends and the over temperature signal when the control system shown in FIG. 8 is used and in which the food temperature drifts with the external temperature (because the refrigerator temperature controller is fed by the measured temperature and not by the estimated food temperature) but the over temperature signal is coherent with the actual food temperature. In this case we assumed that the estimation algorithm is used to inform the customer about possible risks of Listeria bacteria proliferation, for this reason approximately a 4° C. temperature threshold has been chosen.
Figure 10:
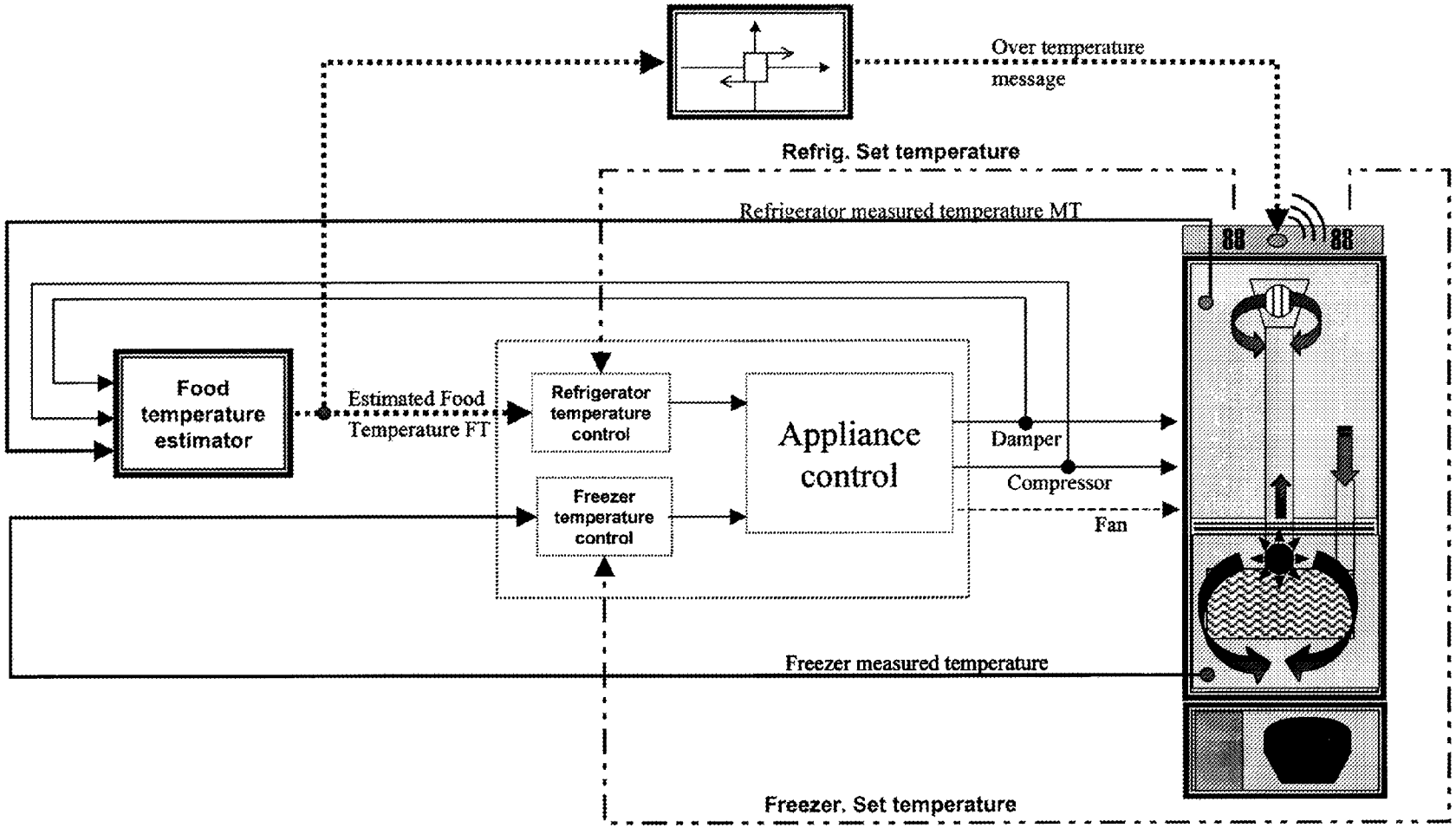
FIG. 10 shows a block diagram where the estimated food temperature according to the invention is used both to guarantee a precise food temperature control and to provide a coherent over-temperature alarm.
Figure 11:
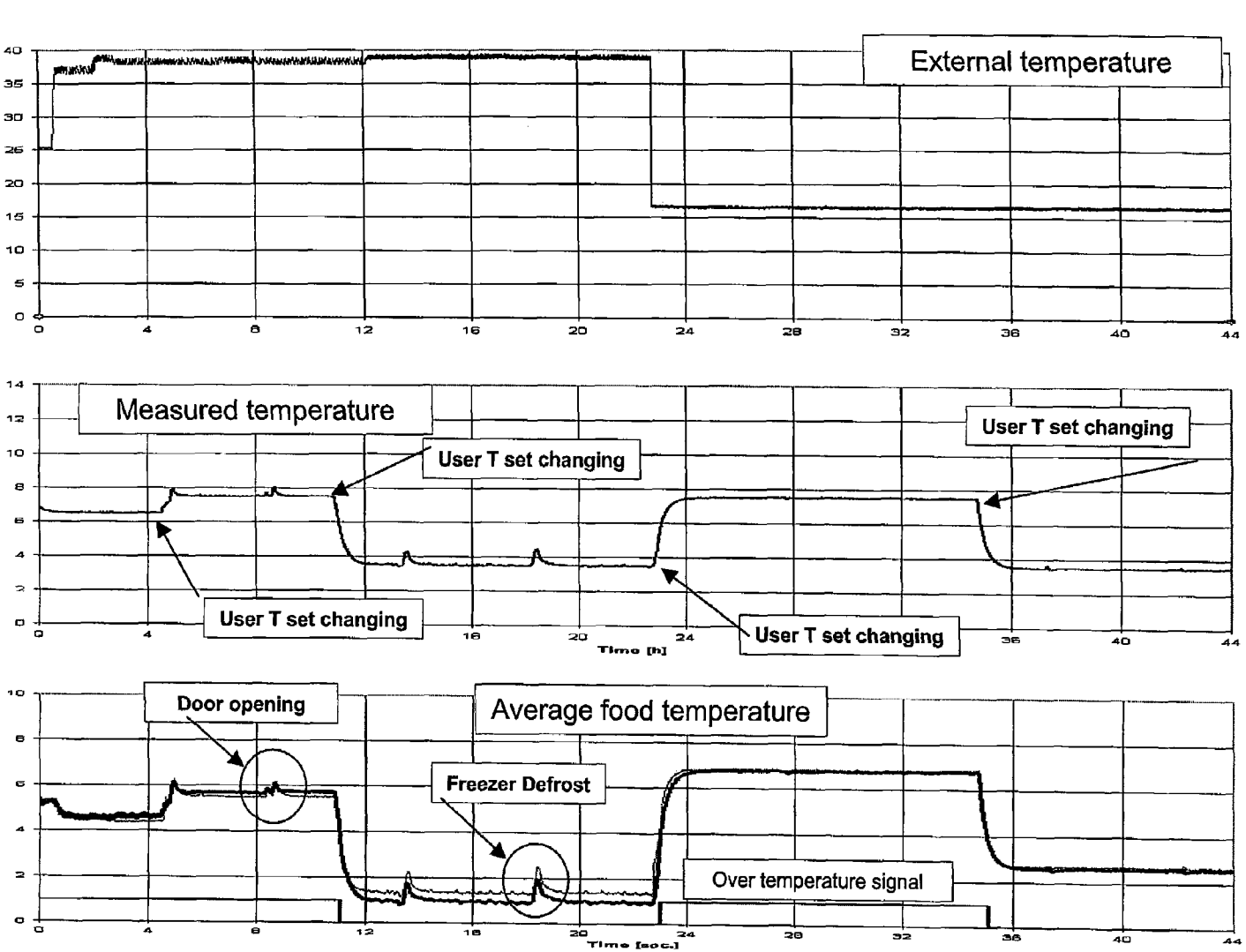
FIG. 11 is a diagram showing the results of about forty-four hours of test on a real appliance controlled according to the block diagram of FIG. 10 where an in house condition was reproduced (door opening, external temperature changes, set temperature changes and freezer defrosts).

Another purpose of the present invention is the generation of coherent over temperature alarms or warnings. FIG. 8 shows a block diagram describing a possible implementation of this further embodiment. The estimated food temperature is compared to a set of predetermined thresholds (for example according to a hysteresis method) and, based on the comparison, a warning signal is sent to the customer. An example of the application of this concept is shown in FIG. 9. In this case a warning signal is generated every time the estimated food temperature is higher than about 4° C. (because in this condition the non-proliferation of some bacteria, for instance "Listeria", is not guaranteed.). It can be noticed the coherence of the alarm signal with the actual food temperature. To highlight the effect of the food temperature estimation block in the warning message generation, the control scheme of FIG. 8 has been used. The measured temperature is kept constant in average against the external temperature changes (by the control algorithm) but the warning message changes according to the actual food temperature. A further embodiment of the present invention resides in the use of the food temperature estimator both to provide a more precise feedback temperature (according to FIG. 4) and to generate a coherent over temperature alarm (as shown in FIG. 8). This kind of solution is described in FIG. 10. The examples considered in the present description have been chosen as a method to disclose the present solution and they are not to be confused with the body of the overall inventive concept of a method to estimate and control the average food temperature in a refrigerator (or freezer) cavity. According to this concept, this is done by correlating the measure of a temperature sensor inside the cavity with the actuators trends. The considered estimator (eq. 5, 6, 7, 8 and FIG. 3) represents a possible method to implement this concept. For this purpose it's important to remark that the classical and well-known estimation techniques can be used in supporting the implementation of the concept. We mention for example the use of Kalman filter, and soft computing techniques such as neural-fuzzy algorithms.

It is clear that the present invention provides a more precise food temperature control and a more reliable over temperature warning message. This is done by converting the rough temperature coming from the temperature sensor in the refrigerator or freezer cavity into an estimation of the average temperature of the food stored in the cavity. One of the main advantages in using this technical solution comes from the fact that it doesn't require the use of specific temperature sensors. The conversion can be done by using the temperature sensor that is traditionally present in the refrigerator cavity and by correlating this measured value with the actuator trends without the addition of further dedicated sensors.

The invention claimed is:

1. A method for controlling the temperature inside a cavity of a cooling appliance provided with a temperature sensor inside the cavity and with an actuator for adjusting a cooling capacity of the appliance, the method comprising:

estimating a food temperature on the basis of a temperature value from the temperature sensor and a predetermined function of a status of the actuator, wherein the actuator of the cooling appliance is selected from the group consisting of a compressor, a damper, a fan, an evaporator defrost heater and combinations thereof; and automatically adjusting a refrigerator set temperature according to the estimated food temperature.

2. The method according to claim 1, wherein the food temperature is estimated in order to keep it constant despite variations of external temperature conditions.

3. The method according to claim 1, further comprising providing an alarm signal when the estimated food temperature is above a predetermined set value.

4. The method of claim 3, wherein the predetermined set value is approximately 4° Celsius.

5. The method according to claim 1, wherein the food temperature is estimated by converting the temperature value from the cavity temperature sensor-using soft computing techniques.

6. The method according to claim 5, further comprising measuring an external temperature using a dedicated sensor.

7. The method according to claim 5, further comprising estimating an external temperature using estimation techniques.

8. The method according to claim 1, wherein automatically adjusting the refrigerator set temperature according to the estimated food temperature provides a substantially constant food temperature regardless of external temperature changes.

9. A cooling appliance comprising:

a cavity;

a temperature sensor inside the cavity;

an actuator, selected from the group consisting of a compressor, a damper, a fan, an evaporator defrost heater and combinations thereof, for adjusting a cooling capacity of the appliance; and an electronic controller adapted to estimate a food temperature on the basis of a temperature value from the temperature sensor and on a predetermined function of a status of the actuator and adapted to adjust a refrigerator set temperature according to the estimated food temperature.

* * * * *

UNITED STATES PATENT AND TRADEMARK OFFICE

CERTIFICATE OF CORRECTION

PATENT NO. : 7,596,432 B2
APPLICATION NO. : 11/470650
DATED : September 29, 2009
INVENTOR(S) : Boer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 292 days.

Signed and Sealed this

Twenty-eighth Day of September, 2010

David J. Kappos

David J. Kappos
*Director of the United States Patent and Trademark Office*